US006119557A

United States Patent [19]

Penisson

[11] Patent Number: 6,119,557

[45] Date of Patent: Sep. 19, 2000

[54] POWER TONG WITH SHUTDOWN SYSTEM AND METHOD

[75] Inventor: Dennis Penisson, Raceland, La.

[73] Assignee: Bilco Tools, Inc., Houma, La.

[21] Appl. No.: 09/138,947

[22] Filed: Aug. 24, 1998

[51] Int. Cl.[7] ..... B25B 17/00

[52] U.S. Cl. ..... 81/57.44; 81/57.33

[58] Field of Search ..... 81/57.19, 57.33, 81/57.44

[56] References Cited

U.S. PATENT DOCUMENTS 4,776,243 10/1988 Schulze-Beckinghausen et al. ..... 81/57.44

*Primary Examiner*—James G. Smith
*Attorney, Agent, or Firm*—Browning Bushman

[57] ABSTRACT

A power tong 10 for making up and breaking apart threaded oilfield tubular connections includes a frame 11 having an open throat 20, a rotary ring 16 having an open throat 22, and a door 24 for closing over the open throat for safety. Hydraulic motor 42 is regulated by a control valve 52 for rotating the ring 16 which in turn rotates the oilfield tubular. A switch 46 responsive to the position of the door 24 controls the flow of air pressure to a cylinder 50, which renders active valve operator 54 which controls valve 52. According to the method of the invention, the door 24 must first be closed so that the switch 46 renders the valve operator 52 active, and the valve operator 52 must be reset once the door is opened before it can be manipulated to operate the motor control valve 52.

20 Claims, 4 Drawing Sheets

POWER TONG WITH SHUTDOWN SYSTEM AND METHOD

FIELD OF THE INVENTION

The present invention relates to the operation of power tongs of the type commonly used to make up and break apart threaded oilfield tubular connections. More particularly, this invention relates to an improved tong shutdown system and method which reliably ensures that the door of an open throat power tong is properly closed before rotation of the tong rotary ring.

BACKGROUND OF THE INVENTION

Power tongs or oilfield equipment commonly used to make up and break apart threaded connections on casing, tubing, or other oilfield tubulars. While various types of power tongs have been devised, the type most preferred by many oilfield operators for over fifty years has a tong body or frame with an open throat, and a partial rotary ring or rotary gear with a corresponding throat. When the frame and rotary ring throats are aligned, the power tong may be moved laterally on and off the oilfield tubular. Once the tubular is positioned within the rotary ring, the door attached to the frame is closed and the ring engages the tubular and rotates to make up or break apart the threaded connection.

Because of a need for safety, oilfield equipment operators require guards or doors on the open throat frame of a power tong. If the door is not properly closed before the tong is actuated, an operator hand may accidentally enter the throat area. The high speed rotation of the rotary ring has injured many oilfield operators. In some cases, the worker appendage slips into the area of the rotary ring throat, severely injuring the worker.

Various types of systems have been devised which seek to prevent these injuries, and more particularly allow rotation of the rotary ring only when the tong door is properly closed. When the tong door or guard is opened to allow lateral movement of the power tong onto and off the tubular, the system does not allow rotation of the rotary ring or rotary gear. A common method of accomplishing this goal it utilizes a hydraulic valve adjacent the tong door, with the valve being opened or closed by a pin or other member movably responsive to the door position. The hydraulic valve may be provided with fluid from a line connected to the fluid supply line to the motor, and a return line from the hydraulic valve may be connected to the hydraulic return line from the motor, i.e., the hydraulic tong motor for rotating the rotary ring or gear and the hydraulic valve are fluidly in parallel. When the guard is properly positioned closed, the hydraulic valve is also closed and high pressure fluid is available to power the tong hydraulic motor, thereby rotating the ring. When the door is not properly fully closed, the hydraulic valve is open and bypasses fluid back to the return line. This bypass prevents the buildup of high pressure fluid being supplied to the tong motor, thereby hopefully preventing rotation of the partial ring.

The safety system as described above has several shortcomings which have limited its acceptance, and most importantly have not prevented some accidents to oilfield operators. The prior art system requires additional valves and hoses which must be added to the hydraulic system. These hoses and valves may leak, and in frustration the oilfield operator may bypass this safety system. Moreover, even when the hydraulic valve is opened and fluid is bypassed through the hydraulic valve and returned to the hydraulic power source, some fluid under pressure is still available to drive the power tong motor. Accordingly, the hydraulic valve may be open but the motor may still rotate the ring, although at less than its full speed. Any rotation of the rotary ring or gear with the door not properly closed can be dangerous and may injure the oilfield worker.

In an attempt to overcome the shortcomings of the system described above, another method has been developed for preventing rotation of the rotary ring when the tong door is open. This alternative system completely blocks the flow of fluid to the motor when the hydraulic valve is closed by placing the hydraulic valve and the motor fluidly in series, with the motor downstream from the hydraulic valve. This system has the disadvantage of also requiring additional valves and hoses, thereby making the hydraulic system more complex. As with the system described earlier, the expense of additional valves and hoses and a possibility of fluid leakage encourage the operator to bypass the safety system. Also, this latter system undesirably allows the tong motor to run when the tong door is closed but without an operator intentionally resetting the system. Accordingly, while the tong door should be closed before high pressure fluid to be available to the power tong motor, operator intervention is not required to purposefully initiate or reset the system in order to supply fluid to the power tong motor once the door is closed. If the hydraulic safety valve is accidentally bumped at the same time the motor control valve handle is bumped, the tong motor could restart.

The disadvantages of the prior art are overcome by the present invention, and an improved method and system are hereinafter disclosed for operating a power tong while improving operator safety. The system of the present invention desirably stops rotation of the rotary ring without creeping of the rotary ring in a manner of the system most commonly used in the prior art. Moreover, the system of the present invention does not require altering the conventional fluid delivery system of the tong which supplies fluid pressure from the hydraulic fluid source to the power tong motor.

SUMMARY OF THE INVENTION

In a preferred embodiment, the power tong for making up and breaking apart threaded oilfield connections includes a tong frame having a frame open throat, a rotary ring rotatably supported on the tong frame and having a ring open throat, and a door for closing the frame open throat. With the door open, the power tong may be moved laterally on and off an oilfield tubular connection once the ring open throat is aligned with the frame open throat. The ring is powered by a hydraulic motor supported on the frame for rotating the rotary ring. A motor control valve is operable to control flow of high pressure fluid from a high pressure source to the hydraulic motor. A pilot valve or switch supported on the tong frame outputs a signal in response to the position of the door to a valve operator which controls operation of the motor control valve. A hydraulic cylinder or other fluid pressure responsive member automatically engages and disengages operation of the valve operator and thus the motor control valve in response to the signal from the switch. A fluid supply line is provided for supplying pressurized fluid, and preferably a pneumatic pressure, to the switch and then to the fluid pressure responsive member. When the switch outputs a signal indicative of the door being closed to the fluid pressure responsive member, the valve operator is automatically engaged such that the movement of the valve operator controls the motor control valve and thus supplies fluid pressure to the hydraulic motor. When the switch outputs a door open signal to the fluid pressure responsive member, the valve operator is automatically disengaged such that movement of the valve operator does not control operation of the motor control valve. The fluid pressure responsive member is biased in the disengaged position, preferably by a spring, to provide for fail safe operation. In a preferred embodiment, the switch is thus opened to pass pneumatic fluid to the fluid pressure responsive member when the door is closed, and the switch is closed to automatically prevent transmission of pneumatic pressure to the fluid pressure responsive member when the door is opened.

To further enhance reliability of this shutoff system, a pivotal link member is preferably positioned between the door and the switch. The link member thus moves in response to movement of the door to activate and deactivate the switch. This link member allows the switch to be located on the tong frame substantially rearward of the door, and preferably opposite the door with respect to a centerline of the rotary ring. An adjustment screw is provided for controlling the output signal from the switch in response to the position of the link member and thus the position of the door.

As previously noted, the fluid pressure responsive member may be a pneumatic cylinder with a rod which is extended in response to pneumatic pressure, i.e., when the switch is open indicative of the door being closed. The valve operator may be a conventionally manually operated valve handle which controls operation of the motor control valve. The valve handle may be pivotally mounted with respect to the pneumatic cylinder, such that when the cylinder rod is fitted within a detent, movement of the handle controls the operation of the motor control valve. When the cylinder rod is moved out of the detent, the handle rotates with respect to the pneumatic cylinder and movement of the handle does not affect operation of the motor control valve. Movement of the handle is preferably restricted by a conventional stopping member, such as one or more chains, thereby preventing the operator from operating the motor control valve when the cylinder rod is out of the detent.

According to the method of the invention, the motor control valve is operated by the handle or other valve operator, which in turn is rendered operative or inoperative by a pneumatic cylinder or other fluid pressure responsive member. The pneumatic cylinder may be supplied with pressurized air when the switch is open, indicative of a door closed position. Accordingly, the door must first be closed before movement of the valve operator will allow hydraulic fluid to pass to the motor which rotates the ring. Moreover, once the door is opened, operator intervention is required to reset the handle in a position such that the hydraulic cylinder will allow operation of the motor control valve in response to the valve operator. This resetting feature desirably ensures that the tong motor cannot be operated after the door is opened while the tong is powered, then the door again closed. The operator must first reset the handle in a position whereby it may subsequently be moved to activate the motor control valve.

It is an object of the present invention to provide an improved system for operating an open throat power tong which improves tong safety by disengaging operation of the hydraulic motor when the door is open and wherein the control system does not require altering or tying into the conventional fluid power system which supplies hydraulic fluid pumped from the hydraulic fluid source to the motor and then back to the hydraulic fluid source.

It is a further feature of the invention that the system and method of the present invention desirably do not require electronic operated components, which are generally considered undesirable when the power tong is operated in the potentially hazardous environment of the hydrocarbon recovery well.

A significant feature of the invention is that tong safety is improved by requiring that the operator reset the handle or other valve operator prior to the valve operator movement controlling the motor control valve.

Still another feature of the invention is that the safety features of the invention allow the operator to easily and quickly determine that the safety system components are operating properly by ensuring that the valve operator can only control a motor control valve when the door is properly closed.

A related feature of the invention is that the safety system of the present invention utilizes inexpensive components which are relatively rugged, and may be easily field serviced.

Still another feature of the invention is that the system of the present invention provides a quick response time to disengage operation of the hydraulic motor if the switch signals that the door has moved out of the fully closed position.

An advantage of this invention is that the switch which controls operation of the safety system may be positioned at various locations on the frame of the power tong, and preferably may be spaced away from the vicinity of the door and rearward of a centerline of the rotary ring.

Still another feature of the invention is that the fluid pressure responsive member preferably is supplied with pneumatic fluid pressure, which allows the safety system to be easily installed and field serviced.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
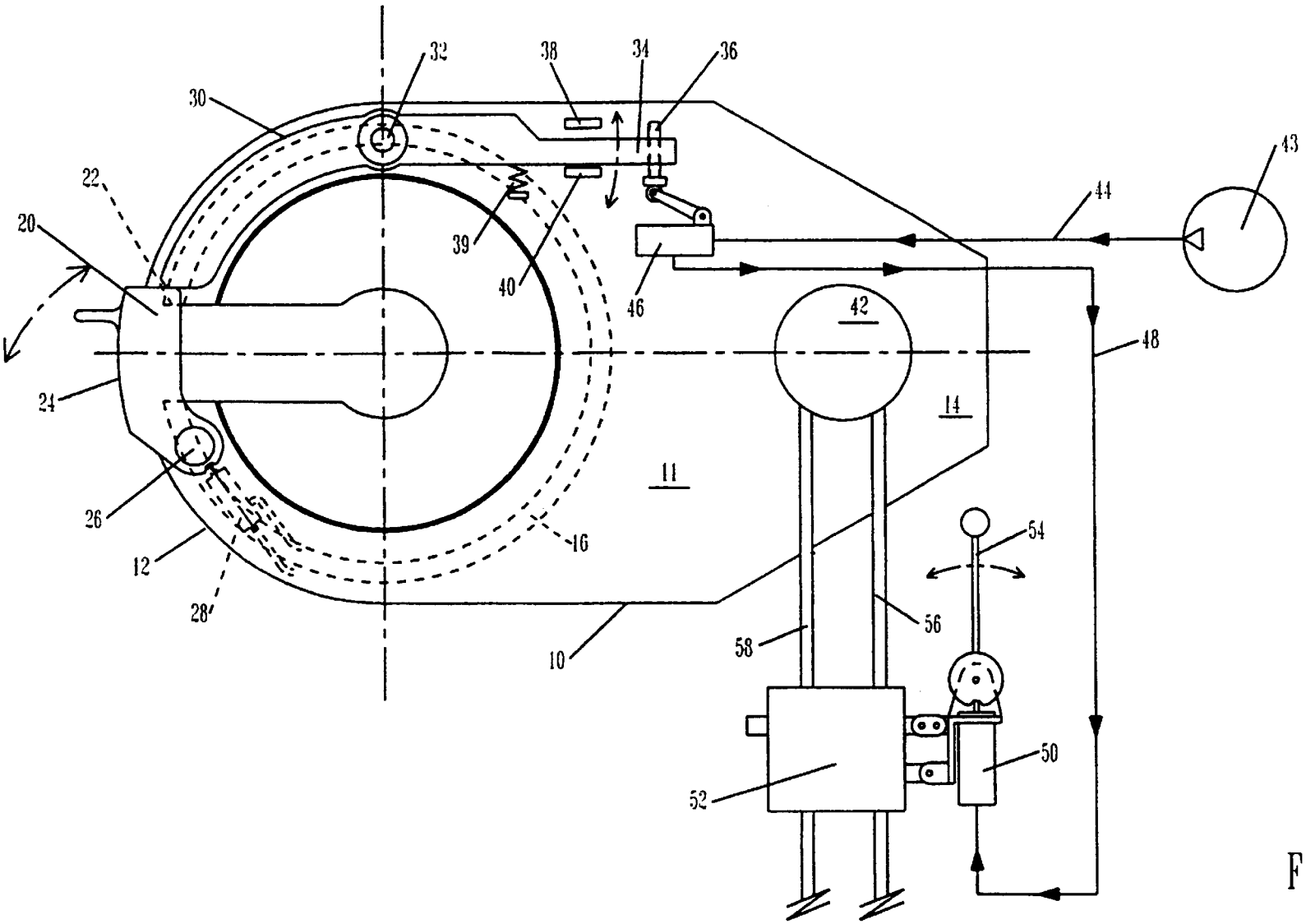
FIG. 1 is a simplified top view of a power tong according to the present invention, illustrating the door in the fully closed position and the switch open to supply pressurized air to the pneumatic cylinder which allows the valve operator to control the motor control valve.

FIG. 1 depicts one embodiment of a power tong 10 for making up and breaking apart in an oilfield tubular connection. Power tong 10 includes a frame 11, which typically comprises upper and lower tong plates. The frame 10 is thus generally positioned horizontally when the tong is used at a well site to make up and break apart tubular connections. The tong frame 11 includes a front portion 12 with an open throat area 20 and a rear portion 14 which conventionally supports the hydraulic motor 42. As shown in FIG. 1, the open throat 20 of the frame is covered by a door 24 which as shown is in the closed position. The closed door 24 thus provides safety to the tong operator to prevent a hand from moving laterally inward through the open throat 20 of the power tong when operating. Door 24 may be pivotally supported on the frame 11 by pivot pin 26. Depending on the configuration, the door 24 may thus serve a primary function as a guard. In other embodiments, door 24 may both serve both as a guard and to minimize spreading of the open throat area 20 of the power tong 10 when very high torque is applied to the rotary ring or gear.

Power tong 10 also includes a rotary ring 16 whose outline is generally shown in FIG. 1. The rotary ring 16 is rotatably supported on the tong frame 11 and has its own open throat 22. A power tong may thus be moved laterally on or off an oilfield tubular connection when the open throat 22 of the ring is aligned with the open throat 20 of the frame 11. The ring 16 is thus rotated by the hydraulic motor 42, and conventionally a gear-type train (not depicted) may be provided between the motor 42 and the ring 16 for this purpose. Those skilled in the art recognize that various techniques may be utilized for engaging and disengaging heads carried by the rotary ring with the oilfield tubular. The hydraulic motor 42 thus rotates the ring 16 about a ring centerline 18, which also coincides with the centerline of the tubular rotated by the power tong.

Although not part of the present invention, FIG. 1 depicts in dashed lines the general position of a typical hydraulic valve 28 which may be used according to prior art techniques as discussed above, with the hydraulic valve 28 being responsive to the position of the door and being placed either in parallel with or in series with the hydraulic motor of the power tong.

In a preferred embodiment of the invention, a switch 46, which alternatively may be considered a pilot valve, is supported on the tong frame 11 at a position generally on the rearward end 14 of the tong. As shown in FIG. 1, air pressure from source 43 is input via line 44 to the switch 46, and line 48 and then extends from the switch to the pneumatic cylinder 50. A link member 30 is pivotally mounted on a tong frame 11 about pin 32. The link member 30 is responsive to the open and closed movement of the door 24 to activate and deactivate the switch 46. By providing the link member 30, the switch 46 desirably is not positioned adjacent the door as was the hydraulic valve 28, and instead the switch 46 is mounted at any convenient location on a rearward end of the tong. More particularly, the link member 30 allows the switch 46 to be mounted laterally opposite the door with respect to the centerline 18 of the rotary ring 16. A pair of blocks 38 and 40 each affixed to the tong frame 11 limit travel of the link member 30. An adjustment member 36 is provided on the rearward end 34 of the link member 30, and may conventionally comprise a bolt threaded to the end 34, with a suitable locking nut or other conventional member (not shown) used to prevent inadvertent rotation of the bolt 36. A suitable biasing member, such as spring 39, may be used to bias the link member 30 so that the switch 46 is normally closed. Alternatively, the switch 46 is biased closed, and the bias of the switch 46 may be sufficient to ensure that the link member 30 will move to a door open position as soon as the door 24 is partially opened. When the door 24 is positioned in its fully closed position, movement of the door to that position moves the link member 30, which then presses against the limit switch 46 to open the limit switch, thereby supplying pneumatic pressure along line 48 to the cylinder 50. Line 48 thus serves as a safety control line for interconnecting the switch 46 and the fluid pressure responsive member 50, and more particularly serves to transmit a door closed or a door open signal to the member 50.

FIG. 1 also depicts a conventional valve operator or handle 54 so that the tong operator can control the motor control valve 52, which regulates the flow of pressurized fluid along the line 56 to the motor 42, and from the motor 42 along line 58 back to the pressurized fluid source. Motor control valve 52 is a conventional valve used to control the flow of fluid to a motor, and accordingly is only generally discussed herein. Valve 52 and thus the valve handle 54 may be supported on the power tong, but alternatively may be mounted on a pedestal or other support spaced from the frame 11 of the power tong. As discussed further below, pneumatic fluid to the cylinder 50 renders the valve operator 54 active, so that the tong operator can manipulate handle 54 and thereby regulate operation of the motor control valve 52.

Figure 2:
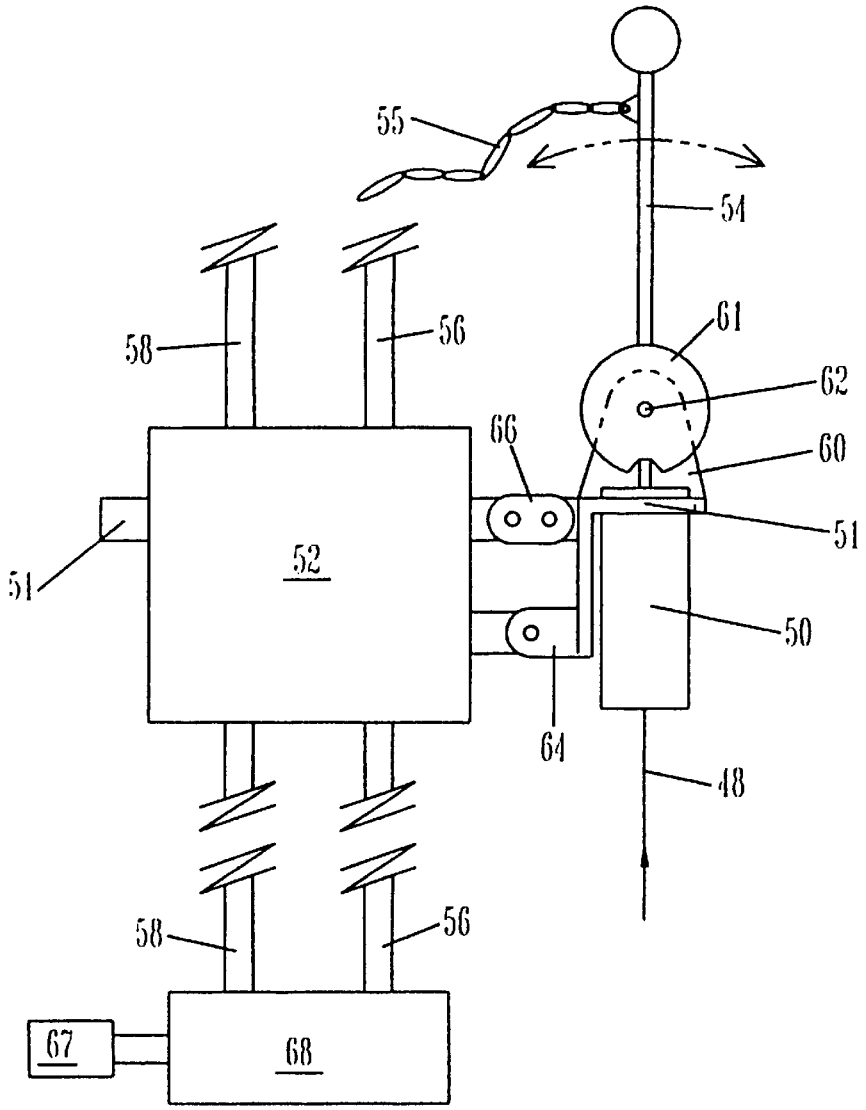
FIG. 2 is a more detailed view of the motor control valve, the hydraulic cylinder, and the hand operator generally shown in FIG. 1.

FIG. 2 depicts in greater detail the motor control valve 52, the pneumatic cylinder 50, and the valve operator or handle 54. Those skilled in the art recognize that hydraulic fluid pressure is output from a hydraulic pump or other power source 68 along line 56, with the pump 68 conventionally being powered by a diesel engine 67. Valve 52 preferably is biased to close line 56, and a portion of a spring biased spool valve 51 is generally shown in FIG. 2 to serve this biasing function. The valve 52 conventionally is operated by a valve operator such as handle 54, with linkage member 64 and 66 typically being provided between the handle 54 and the body of the valve 52 to control the flow of fluids through the valve 52. According to the present invention, the pneumatic cylinder 50 is mounted on bracket 51. Vertical support 60 is also fixed to the bracket 51, with the support 60 pivotally supporting the handle 54 and the plate 61 thereon. Handle 54 and plate 61 thus rotate about the support 60 at pin 62. Various types of mechanical stops, such as a chain 55 as shown in FIG. 2, may be used to limit rotation of the handle 54 when it is manipulated to control operation of the motor control valve 52.

Figure 3:
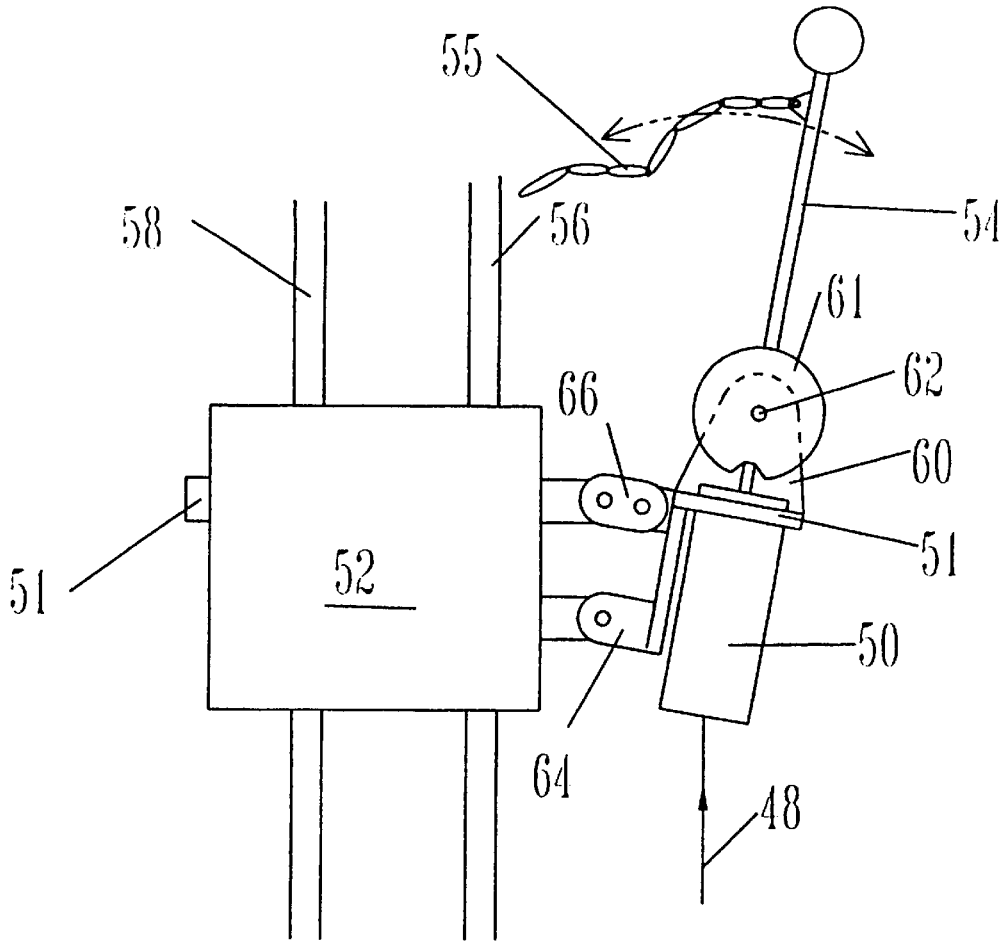
FIG. 3 illustrates the valve operator as shown in FIG. 2 moved to activate the motor control valve to supply high pressure fluid to the tong motor.

FIG. 3 depicts a situation wherein pneumatic fluid along line 48 is supplied to the air cylinder 50, so that the piston rod 70 of the cylinder is extended and fits within the detent 74 of the plate 61. When the cylinder rod 70 is in the detent 74, the handle 54 may be rotated from the position as shown in FIG. 2 to the position as shown in FIG. 3, thereby pulling the linkage member 66 outward from the valve spool 52, and allowing pressurized fluid to flow along line 56 to operate the motor 42. In the FIG. 3 embodiment, the cylinder rod 70 thus fits within the detent 74, and the hand operator 54 is now secured to the bracket 51 to allow operation of the valve 52.

Figure 4:
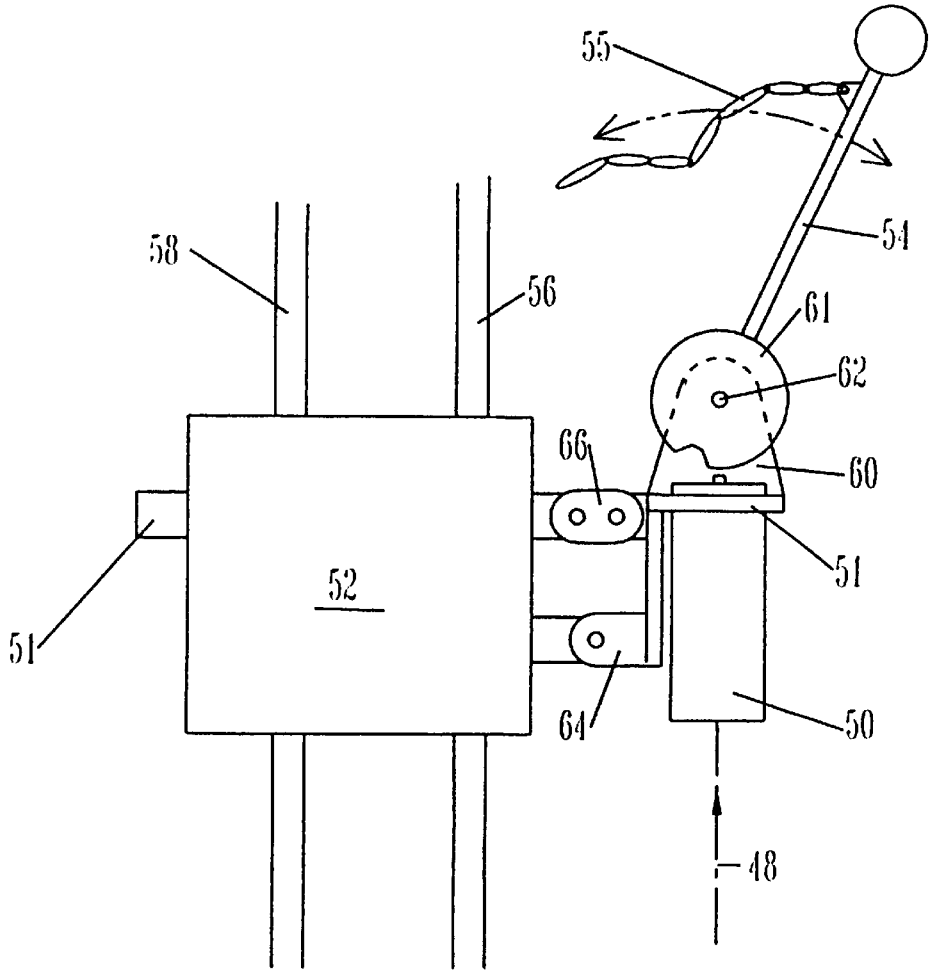
FIG. 4 illustrates deactivation of the pneumatic cylinder, such that movement of the valve operator does not affect operation of the motor control valve which is biased closed for preventing the supply of hydraulic fluid to the tong motor.

FIG. 4 depicts the situation where the pneumatic fluid is not supplied to the cylinder 50, so that the piston rod 70 is retracted. Pneumatic cylinder 50 is thus biased in a conventional manner so that the piston rod 70 is normally retracted, the rod 70 is only extended when pneumatic fluid in the line 48 is sufficient to overcome this bias and extend the rod 70. Also, the rotation of the handle 54 on support 60 is quite free, so that if the rod 70 is retracted when the handle is vertical, as shown in FIG. 2, the handle 54 will pivot so that the detent 74 rotates out of alignment with the rod 70. If desired, the handle 54 could be weighted or otherwise pivotably mounted in an off center manner to ensure that the detent 74 does not remain aligned with the rod 70 once pressure is released to the cylinder 50.

If the door is inadvertently opened, movement of the link member 30 will cause the switch 46 to close, thereby terminating the fluid pressure to the cylinder 50 and retracting the piston rod 70. In that situation, the rotated position of the handle 54 no longer activates the control valve 52, which is biased closed for shutting off the flow of pressurized fluid along the line 56 through the motor 42. Thus the opening of the door 52 will provide a quick response to terminate fluid flow to the motor 42, thereby stopping rotation of the ring 16. Thus, it should be understood that if the door is not fully closed and the tong operator manipulates the handle 54, the handle may be rotated but disengagement of the piston rod 70 and the plate 61 does not allow movement of the handle 54 to control the valve 52. If fluid pressure is lost to the cylinder 50 while the handle 54 is positioned for otherwise allowing fluid pressure to flow through the motor control valve and to the tong motor, the cylinder rod 70 promptly snaps out of the detent 74 and the valve 52 returns to its biased position for stopping hydraulic fluid flow to the motor, thereby stopping rotation of the rotary ring.

A particular feature of the invention is that the tong operator intentionally must reset the handle 54 before resuming activation of the motor 42 once the door is opened. It should be understood that if the handle 54 in the position as shown in FIG. 4, even if pneumatic fluid is supplied via line 48 to extend the piston rod 70, the rod 70 will not fit within the detent 74 and thus manipulation of the handle 54 still does not control operation of the valve 52. The tong operator must thus first position the handle vertically as shown in FIG. 2 so that the extended piston rod will fit within the detent 74, then the handle 54 must be manipulated for controlling operation of the valve 52.

The tong shutdown system of this invention has a benefit of being operable to shut off the flow of hydraulic fluid to the motor without tying the shutdown system into the hydraulic fluid lines which otherwise normally connect the hydraulic tong motor with the hydraulic fluid source. Although preferably this safety system utilizes pneumatics, the pressure to automatically operate the fluid pressure responsive member 50 alternatively could come from the same source which powers the motor, or from a separate hydraulic source. Because of the hazardous environment in which power tongs are frequently utilized, an electrical safety system, while technically feasible, is preferably avoided. The components of the safety system are relatively rugged and are commercially available, are relatively inexpensive, and the system is easily field serviced. The system of the present invention has a quick response time to stop rotation of the rotary ring or gear if the door is opened, and the reliability of the system is enhanced by preferably positioning the switch which is responsive to movement of the door at a location laterally opposite the door with respect to the centerline of the rotating ring.

According to the method of the invention, the operator may easily and quickly determine that the safety system is properly working by observing that the piston rod of the cylinder 50 is retracted when the door is opened. The tong operator must manually reset the handle to a position such that the detent is aligned with the piston rod of the cylinder before fluid pressure to the cylinder will allow the structural interconnection of the handle 54 with the bracket 51, which interconnection is required for the handle movement to operate the valve 52.

The concept of the present invention is to automatically enable or disenable the valve operator or handle in response to the position of the door with respect to the tong frame, thereby stopping operation of the tong if the door is not fully closed. Various designs which achieve this objective will be suggested by the foregoing description, and should be considered within the scope of the invention. The particular mechanical arrangement of components as shown in FIGS. 3 and 4 should thus not be construed as limiting, and structural changes to the depicted embodiment should be understood to be within the scope of the invention.

In the preferred embodiment, the switch 46 outputs a door closed signal, which is pressurized air which passes by the switch 46, to activate the pneumatic cylinder 50 which in turn engages the handle 54 so that it can control operation of the motor control valve 52. The switch 46 outputs a door open signal, which is the absence of pressurized air to the cylinder 50, to prohibit activation of the tong motor 42. In other embodiments, the switch 46 may output other forms of a door open signal or a door closed signal which nevertheless still effectively engage and disengage the valve operator 54 to achieve the purposes discussed herein.

A preferred embodiments invention has been shown and described, and various other modifications and substitutions may be made without departing from the spirit and scope of the invention. Accordingly, it should be understood that the present invention has been described by way of illustration and not limitation, and the scope of the invention is literally as set forth by the following claims.

What is claimed is:

1. A power tong for making up and breaking apart a threaded oilfield tubular connection, the power tong comprising:

a tong frame having a frame open throat;

a rotary ring rotatably supported on the tong frame and having a ring open throat, such that the power tong may be laterally moved on and off an oilfield tubular connection when the ring open throat is aligned with the frame open throat;

a door supported on the tong frame for opening to laterally move the power tong on and off the oilfield tubular connection and for closing over the frame open throat when the oilfield tubular connection is within the rotary ring;

a hydraulic motor supported on the tong frame for rotating the rotary ring;

a motor control valve operable to control flow of pressurized fluid from a hydraulic power source to the hydraulic motor;

a switch supported on the tong frame for outputting a signal in response to the position of the door with respect to the tong frame;

a valve operator for controlling operation of the motor control valve;

a fluid pressure responsive member for automatically engaging and disengaging operation of the valve operator and thus the motor control valve; and a safety control line for interconnecting the switch and the fluid pressure responsive member, such that the switch controls operation of the valve operator by transmitting a closed door signal to the valve operator when the door is closed, and the switch controls operation of the valve operator by transmitting an open door signal to the valve operator when the door is open.

2. The power tong as defined in claim 1, wherein the safety control line supplies pneumatic pressure from the switch and then to the fluid pressure responsive member.

3. The power tong as defined in claim 1, wherein the fluid pressure responsive member is biased for disengaging operation of the motor control valve.

4. The power tong as defined in claim 1, wherein the switch is open to transmit fluid pressure along the safety control line to the valve operator when the door is closed, and the switch is closed to prevent fluid pressure transmission along the safety control line to the valve operator when the door is open.

5. The power tong as defined in claim 1, further comprising:

a reset mechanism for requiring manual resetting of the valve operator to a reset position before the fluid pressure responsive member may automatically engage operation of the valve operator.

6. The power tong as defined in claim 1, further comprising:

a link member pivotally supported on the tong frame and moveable in response to the position of the door, such that the switch is activated by the link member for outputting the closed door signal in response to the closed position of the door.

7. The power tong as defined in claim 6, wherein the link member extends rearward from the door past a centerline of the rotary ring, such that the switch is positioned laterally opposite the door with respect to the centerline of the rotary ring.

8. The power tong as defined in claim 6, further comprising:

an adjustment member for adjusting movement of the link member required to activate the switch.

9. The power tong as defined in claim 1, wherein the fluid pressure responsive member includes a fluid powered cylinder having a cylinder rod which is extended in response to pressurized fluid passing by the switch and to the fluid cylinder, and the valve operator includes a detent mechanism for cooperation with the cylinder rod, such that the valve operator may control operation of the motor control valve when the cylinder rod is positioned within the detent, and the valve operator is prevented from controlling the motor control valve when the cylinder rod is not positioned within the detent.

10. The power tong as defined in claim 1, wherein the valve operator is a hand-operated handle rotatable with respect to the motor control valve for controlling operation of the motor control valve; and a stop member for limiting rotation of the hand-operated handle with respect to the motor control valve.

11. The power tong as defined in claim 4, further comprising:

a link member pivotally supported on the tong frame and moveable in response to the position of the door, such that the switch is activated by the link member for outputting the closed door signal in response to the closed position of the door.

12. The power tong as defined in claim 11, further comprising:

the link member extends rearward from the door past a centerline of the rotary ring, such that the switch is positioned laterally opposite the door with respect to the centerline of the rotary ring; and an adjustment member for adjusting movement of the link member required to activate the switch.

13. A power tong for making up or breaking apart a threaded oilfield tubular connection, the power tong comprising:

a tong frame having a frame open throat;

a rotary ring rotatably supported on the tong frame and having a ring open throat, a door supported on the tong frame for opening to laterally move the power tong on and off the oilfield tubular connection and for closing over the frame open throat when the oilfield tubular connection is within the rotary ring;

a hydraulic motor for rotating the rotary ring;

a motor control valve operable to control flow of pressurized fluid from a hydraulic power source to the hydraulic motor;

a switch for outputting a signal in response to the position of the door with respect to the tong frame;

a valve operator for controlling operation of the motor control valve;

a fluid pressure responsive member for engaging and disengaging operation of the valve operator, the fluid responsive member being biased for disengaging operation of the valve operator; and a safety control line for interconnecting the switch and the fluid pressure responsive member, such that the switch controls operation of the valve operator by transmitting a closed door signal to the valve operator when the door is closed, and the switch controls operation of the valve operator by transmitting an open door signal to the valve operator when the door is open.

14. The power tong as defined in claim 13, wherein the safety control line supplies pneumatic pressure from the switch and then to the fluid pressure responsive member.

15. The power tong as defined in claim 13, further comprising:

a reset mechanism for requiring manul resetting of the valve operator to a reset position before the fluid pressure responsive member may engage operation of the valve operator.

16. The power tong as defined in claim 13, wherein the valve operator is a hand-operated handle rotatable with respect to the motor control valve for controlling operation of the motor control valve; and a stop member for limiting rotation of the hand-operated handle with respect to the motor control valve.

17. A power tong for making up or breaking apart a threaded oilfield tubular connection, the power tong comprising:

a tong frame having a frame open throat;

a rotary ring rotatably supported on the tong frame and having a ring open throat, such that the power tong may be laterally moved on and off an oilfield tubular connection when the ring open throat is aligned with the frame open throat;

a door supported on the tong frame for opening to laterally move the power tong on and off the oilfield tubular connection and for closing over the frame open throat when the oilfield tubular connection is within the rotary ring;

a hydraulic motor supported on the tong frame for rotating the rotary ring;

a motor control valve operable to control flow of pressurized fluid from a hydraulic power source to the hydraulic motor;

a means for outputting a signal in response to the position of the door with respect to the tong frame;

a valve operator for controlling operation of the motor control valve;

an actuator for engaging and disengaging operation of the valve operator and thus the motor control valve; and a safety control line for interconnecting the sensor and the actuator, such that the sensor controls operation of the valve operator by transmitting a closed door signal to the valve operator when the door is closed, and the sensor controls operation of the valve operator by transmitting an open door signal to the valve operator when the door is open.

18. The power tong as defined in claim 17, wherein the safety control line supplies pneumatic pressure from the means then to the actuator.

19. The power tong as defined in claim 17, wherein the actuator is biased for disengaging operation of the motor control valve.

20. The power tong as defined in claim 17, further comprising:

a reset mechanism for requiring manual resetting of the valve operator to a reset position before the actuator engages operation of the valve operator.

* * * * *